United States Patent [19]

Bounds

[11] 4,255,467

[45] Mar. 10, 1981

[54] METHOD FOR GALVANIZING SEAFOOD POTS

[76] Inventor: Edward G. Bounds, 1209 Frederick Ave., Salisbury, Md. 21801

[21] Appl. No.: 972,370

[22] Filed: Dec. 22, 1978

[51] Int. Cl.[2] ..... C23C 1/02; C23G 5/00

[52] U.S. Cl. ..... 427/142; 427/225; 427/310; 427/321; 427/347; 427/433; 118/47; 118/73; 134/19; 427/374.5; 427/247

[58] Field of Search ..... 427/225, 142, 321, 310, 427/247, 347, 433, 374 D; 118/47; 134/19, 20; 43/102

[56] References Cited

U.S. PATENT DOCUMENTS

| | | | |
|---|---|---|---|
| 150,774 | 5/1874 | Morgan | 427/347 |
| 1,053,664 | 2/1913 | Sommer | 427/347 |
| 1,191,526 | 7/1916 | Meaker | 427/321 |
| 1,517,097 | 11/1924 | Podel | 134/19 |
| 1,526,899 | 2/1925 | Bundy | 427/225 |
| 1,726,652 | 9/1929 | Crapo | 427/321 |
| 1,787,141 | 12/1930 | Carroll | 427/347 |
| 2,019,445 | 10/1935 | Crapo | 427/321 |
| 2,374,926 | 5/1945 | Fink | 427/321 |
| 2,520,658 | 8/1950 | Rheem | 427/310 |
| 2,852,410 | 9/1958 | Brewer | 427/310 |
| 3,010,844 | 11/1961 | Klein | 427/321 |
| 3,278,331 | 10/1966 | Taylor | 427/321 |
| 3,320,085 | 5/1967 | Turner | 427/321 |
| 3,753,762 | 8/1973 | Garrison | 427/374 D |
| 3,924,035 | 12/1975 | Miller | 134/19 X |
| 4,096,300 | 6/1978 | William | 427/327 |

*Primary Examiner*—Ralph S. Kendall
*Attorney, Agent, or Firm*—Bacon & Thomas

[57] ABSTRACT

Seafood pots made of wire mesh netting are prepared for galvanizing by first passing them through an incineration chamber to burn, melt and loosen foreign material thereon, and then passing them through a high pressure liquid spray to remove residual burned matter and loosened foreign material. The pots are then ready to be passed through the steps of the galvanizing process, which includes dipping the pots into heated preflux before they are dipped into molten zinc. An inverted drying chamber bridges the distance between the preflux tank and the zinc kettle, through which the seafood pots are moved by conveyor means to dry the preflux, with drying heat within the chamber being drawn from the tank and the kettle. The seafood pots are vibrated as they are withdrawn from the molten zinc to effect an even coating of zinc on the wire mesh netting thereof.

9 Claims, 6 Drawing Figures

METHOD FOR GALVANIZING SEAFOOD POTS

TECHNICAL FIELD OF THE INVENTION

This invention relates to a method and apparatus for galvanizing seafood pots made of wire mesh netting mounted on a frame formed from metallic rods, and more particularly to a method and apparatus for efficiently producing large numbers of galvanized seafood pots each having an unusually high quality zinc coating thereon.

BACKGROUND OF THE INVENTION

The seafood pot is a device used by fishermen to capture crabs, lobsters, eels and similar creatures from the tidal and coastal waters in which they dwell. The construction of seafood pots has evolved over the years, and variation is still found in their design and size. However, the typical seafood pot of today utilizes a frame made from steel rods welded into a box-like configuration, which is enclosed on all sides with wire mesh netting. The wire mesh netting will usually be secured to the steel rods of the frame by metallic rings, and will have mesh openings measuring about an inch or more in diameter. One or more walls of the seafood trap will have an opening formed therein through which the creatures to be trapped can enter, the periphery of the opening being fitted with a wire mesh tapered collar extending into the trap and which prevents the lobster, crab or the like from leaving through the opening once it has entered. Finally, the trap will also usually have a cage formed therein to hold bait, the bait cage also being formed of wire mesh netting.

In use, such a seafood trap is lowered into the fishing waters and is left for long periods of time. The weight of the steel frame is usually sufficient to hold it submerged, but sometimes auxiliary weights are employed. Typically, the fisherman will place his traps one day and will return to raise, empty, rebait and replace them in the water one or several days later. A typical trap will thus effectively remain in the water for many months. Obviously, this immersion of a steel rod and wire mesh netting seafood trap in water for long periods will cause rusting, corrosion and eating away thereof over time, if no preventive measures are taken.

In order to preserve the material of a seafood trap for as long as possible while submerged in water, it has become standard practice to manufacture the trap from wire mesh netting that has been previously galvanized. Typically, the galvanized netting has been secured to an ungalvanzied frame formed of steel rods. This arrangement prolongs the life of the netting, but does not solve all the problems associated with the conventional seafood trap.

A galvanized coating tends to erode in the water, especially in sea and tide waters, where the salt content is high. Thus, over time, the zinc coating flakes away and becomes thinner, until the steel material of the netting shows through in one or more places. Once bare steel appears, rust quickly occurs, and the seafood trap will rapidly deteriorate. Further, the ungalvanized steel bar frame members will rust from the outset, and the result is that the typical seafood trap of this type will have a relatively short life, albeit a longer life than would be possible if no galvanizing were employed.

It has been recognized that the life of the galvanized components of a seafood trap can be greatly prolonged by installing a sacrificial anode thereon. Such an anode consists of a large block of zinc, having connecting wires on its opposite ends. The anode is simply connected to the galvanized wire mesh and, thereafter, the anode itself will erode before the mesh. Such anodes have been found to be effective in use, but they are also expensive.

As has been noted, it has become common to manufacture a seafood pot using wire mesh netting that has been previously galvanized. However, such netting is expensive and can be damaged during installation on its frame, so that bare steel wire may show through. If this damage should occur, then a point of weakness is created wherein rusting action can commence, causing the early death of the seafood pot. To alleviate this damaged netting problem and also to effect galvanizing of the steel frame and the rings used to secure the netting to the frame, it has been proposed to hot dip the completed pot in molten zinc.

While such hot dipping of a seafood pot has been done, it has not been an efficient operation or always successful. Among other problems, it has proved to be most difficult to properly clean mill scale, tar and the like, and other foreign matter from the surface of the components of the seafood pot before hot dipping is done, so that the resultant zinc coating has often been of rather poor quality. Such cleaning is now done with hand labor and, because of the extensive wire length found in the netting, it is difficult to do efficiently and thoroughly. As has been noted, even a single weak point in the zinc coating can prove fatal to the desired lifespan of a galvanized seafood pot and, thus, thorough cleaning before galvanizing is essential.

Because of the difficulties therewith and except for small-scale, hand-operated production activity, it has not proved feasible thus far to hot dip seafood pots after they have been manufactured. Thus, the prevailing style in the seafood industry today is still to make the seafood pot of pregalvanized wire mesh netting, and to utilize sacrificial anodes with the pot, whereby a life span of one or perhaps two seasons for the pots is obtained. This mode of operation in the seafood industry offers several problems.

First of all, the seafood pots themselves are expensive to acquire for the individual waterman who must run a string of several score pots to earn a decent living. The expense of replacing the pots every season or so, because of their deterioration from rust, other erosion, and marine life encrustations, is an added burden that reduces profits and increases the price of seafood. Further, it is a common practice of many watermen to examine deteriorated seafood pots each time they are raised from the water and, if they are too badly decayed, to simply cut them loose and let them settle to the bottom where they rust away and cause pollution problems. There is no incentive today for a fisherman to go to the trouble of loading a deteriorated seafood pot into the boat and bring it back to shore.

Finally, the common use of sacrificial anodes, while effective, is also expensive to the fisherman. For all of the reasons noted, an improvement in the cost and lifespan of seafood pots is needed and would be welcomed by the industry, by environmentalists, and by others concerned about the increasing pollution of our waters. The present invention offers a most significant improvement in this direction.

BRIEF SUMMARY OF THE INVENTION

The method and apparatus of the invention make it possible to efficiently galvanize a seafood pot with a high quality zinc coating that will preserve the pot for a longer period of time than has usually been the case in the past. Moreover, the present method and apparatus can be used both to galvanize a newly manufactured seafood pot made from ungalvanized wire mesh, which significantly reduces the cost of manufacture, and to regalvanize a seafood pot that has been in use for a long period of time.

The ability to efficiently and effectively regalvanize a seafood pot after it has been in use is especially important, for it makes possible a new and valuable concept in seafood fishing. The regalvanizing aspect of the invention in effect allows the fisherman to use the same seafood pot indefinitely, assuming physical damage thereto is avoided. The seafood pots can be collected at the end of each season, regalvanized, and used again the following season. This significantly reduces the capital investment of the fisherman, and provides an incentive to end the practice of abandoning old seafood pots in fishing waters, so that pollution of the waters from this source is directly reduced.

The reason such recycling of seafood pots has not been adopted as a practice heretofore is because of the very great difficulty incurred in cleaning the pot afterr it has been in fishing waters for a season. During the months of use, the wire mesh netting and frame of a seafood pot will become encrusted with barnacles and other marine growth, oil and tar, rust and the like, and the cage-like interior of the trap will become clogged with seaweed and other water vegetation. Until the present invention, all of this foreign material has had to be removed by hand, using wire brushes, scrapers and the like and, at best, such removal is often not complete. This has rendered impractical any serious consideration of recycling seafood pots by having them regalvanized after a season of use, except in very small quantities.

The method and apparatus of the present invention changes all of this by making it possible to quickly and economically clean and regalvanize a seafood pot that has been used for a season or more. The fisherman can now reuse his seafood pots indefinitely.

Moreover, the hot dip process of the present invention will deposit a thick, even coating of zinc on the seafood pot, sufficient to last throughout a season, even with the flaking away caused by immersion in salty water. This avoids the need to use the sacrificial anodes that are now commonplace in the industry, assuming the seafood pot will be regalvanized before it is placed in use again in the following season. The savings to the fisherman from this change in current procedures are obvious.

Another advantage of the invention is that it makes it possible for the fisherman to lease his seafood pots from an enterprise that will undertake to have them regalvanized at the close of each season, which reduces the capital needed by the fisherman to purchase his pots. Nothing like this has been possible heretofore.

The cleaning of all foreign material from the seafood pot is accomplished in the invention by first passing the pot through an incineration chamber, in which the foreign material is burned, melted and loosened from the wire mesh netting and framework of the pot. Immediately thereafter, the seafood pot is passed through a high pressure liquid spray, which is effective to remove all residual burned matter, marine encrustations, rust, and like foreign material that has been loosened by the incineration step of the method. The result is a seafood pot that is cleaner than anything heretofore possible, assuring a high quality zinc coating, with the cleaning having been accomplished economically and in a very short period of time.

The cleaned seafood pot is then passed through a somewhat conventional galvanizing process, with the pot being successively immersed in cleaning, pickling and preflux solutions, followed by immersion in and removal from a kettle of molten zinc. However, between the preflux tank and the zinc kettle, the seafood pot is passed through a heated chamber that effects drying of the preflux, which improves the quality of the zinc coating. In the apparatus of the invention, this heated chamber is uniquely formed as a bridge between the hot preflux tank and the hot molten zinc tank, with the drying heat being provided directly from these two tanks.

In order to assure an even, uniform coating on the seafood pot, such is vibrated while it is being withdrawn from the zinc kettle. Preferably, this is accomplished with the use of a vibrator arm that simply engages the seafood pot, which is carried along suspended from a conveyor means.

A conveyor means is preferably used to move the seafood pot successively through the incinerator and high pressure liquid spray, and then through the galvanizing process. It assures an even, rapid flow of seafood pots in a continuous production line, but also and importantly, makes it possible to control the dwell time of the seafood pot within the incinerator means to avoid damage to the wire mesh netting.

It is the principal object of the present invention to provide a method and apparatus for efficiently galvanizing seafood pots, and assuring a high quality zinc coating thereon.

Another object is to provide a method and apparatus for quickly and thoroughly cleaning a seafood pot, either newly manufactured or one that has been in use in fishing waters, to remove all foreign material therefrom in preparation for galvanizing.

It is also an object of the invention to provide an improved method and apparatus for galvanizing, wherein the preflux is efficiently dried before the seafood pot to be galvanized is placed in the molten zinc kettle.

A further object is to provide a method and apparatus that will assure an even coating of molten zinc on a seafood pot.

Other objects and many of the attendant advantages of the invention will become readily apparent from the following description of the preferred embodiment, when taken in conjunction with the accompanying drawings.

BRIEF DESCRIPTION OF THE DRAWINGS

With respect to the attached drawings.

DETAILED DESCRIPTION OF THE PREFERRED EMBODIMENT

Figure 5:
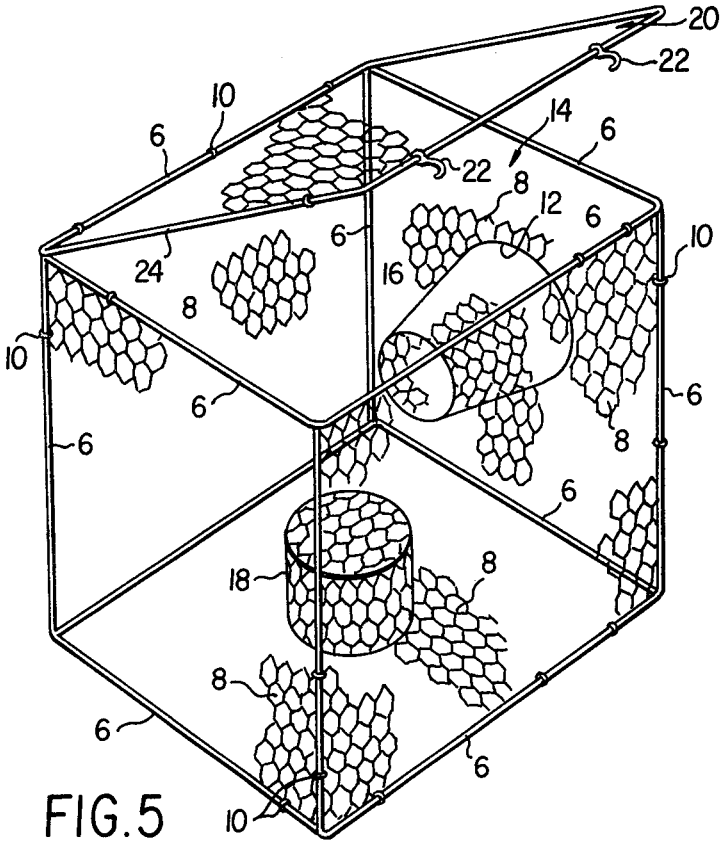
FIG. 5 is a perspective view showing the construction of a typical seafood pot, with the netting broken away in several places for purposes of clarity.

A typical seafood pot of the kind with which the present invention is concerned is shown at 2 in FIG. 5, and includes a box-like frame 4 made from steel rods 6 welded together at their mating ends. The frame 4 will typically measure about two feet in length on each side, and is covered on all of its sides with wire mesh netting 8, secured in place by metallic rings 10 that clamp the edges of the netting to the steel rods 6 at selected places therealong. An opening 12 is provided in at least one sidewall 14 of the seafood trap, and is surrounded internally of the trap with a tapered collar 16, also made of netting. Further, a bait cage 18 formed of netting is located within the trap, and the top wall 20 of the trap is hinged to one of the steel rods 6 so that it can be opened and closed, and is held in place by one or more latches 22. The top wall 20 will typically have its own frame 24 for rigidity.

Typically, the wire mesh netting used for a seafood pot will be 18 gauge woven hex netting made of steel, usually supplied in rolls measuring 24 inches wide. It is to accommodate this 24 inch width that a seafood pot will normally measure 24 inches in a side. In the past, the netting has been galvanized at the factory and is relatively expensive to purchase. With the present invention, plain wire mesh netting can be employed to construct a seafood pot, resulting in reduced costs.

Figure 1:
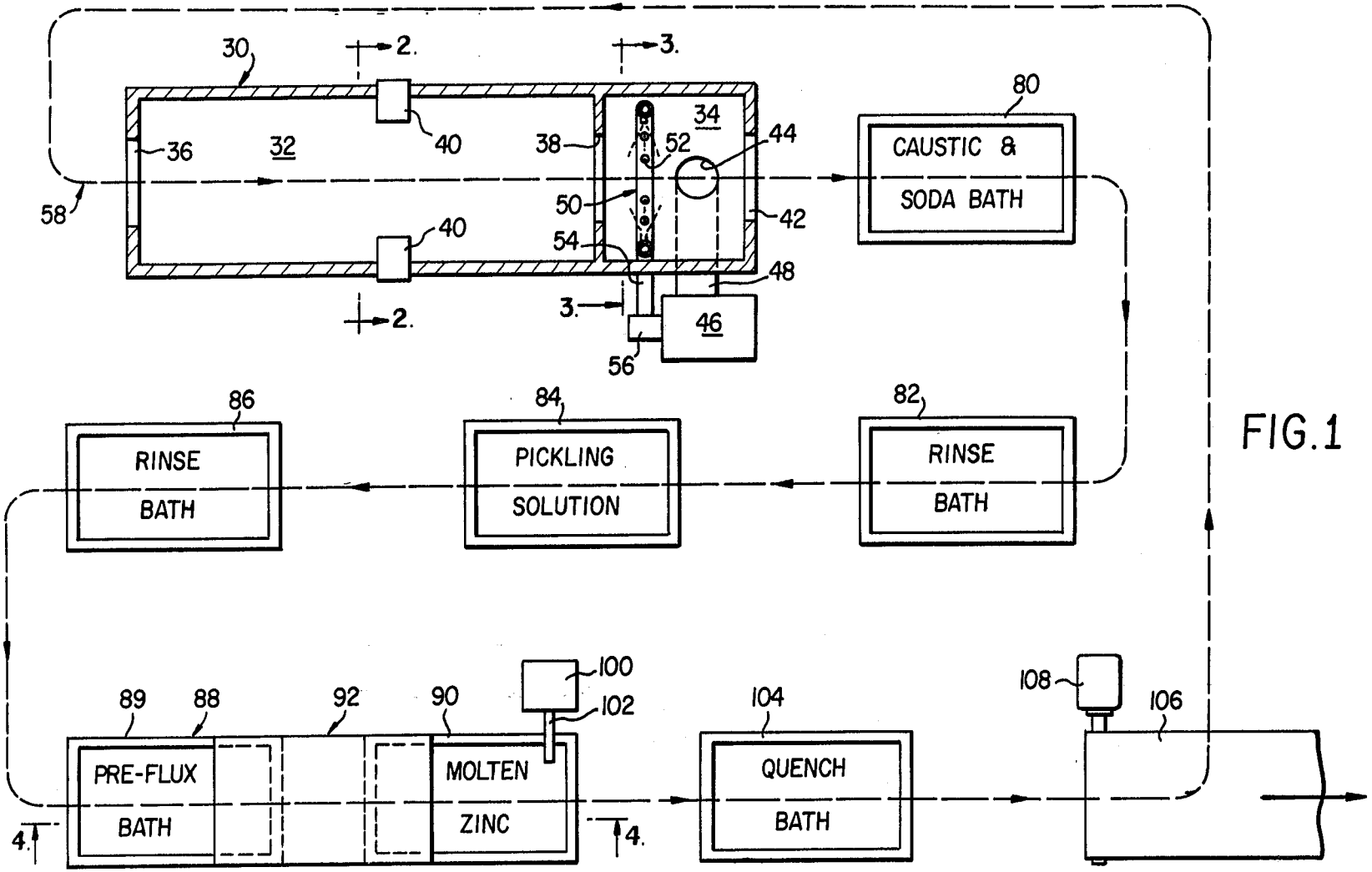
FIG. 1 is a diagrammatic view showing the arrangement of the apparatus of the invention for galvanizing and regalvanizing seafood pots.

Turning now to FIG. 1, the apparatus of the invention for galvanizing and regalvanizing a seafood pot 2 is shown in diagrammatic form, and includes an elongated housing 30 containing an incineration chamber 32 followed immediately by a spraying chamber 34, the incineration chamber 32 having entrance and exit openings 36 and 38, respectively, which preferably are closed by doors, drapes, or other suitable movable closure devices (not shown for clarity) that will help retain heat within the chamber.

The incineration chamber 32 can be provided with heat in several alternative manners, as by using electrical resistance heaters, natural gas heaters, or oil burners. It has been found that good results can be obtained by locating oil burners 40 about midway the length of the chamber 32, and peripherally about the longitudinal axis thereof. The number of burners 40 can be varied, with from four to six being a good arrangement. Further, it has been found that forced air burners of the type that project a jet of flame are well suited to penetrate through the openings of the wire mesh netting of a seafood pot for destroying plant life and other foreign matter contained therein, a fan-shaped jet of flame oriented in a plane extending normal to the longitudinal axis being preferable. The burners 40 can also be staggered somewhat longitudinally of the incineration chamber 32, if desired, to provide a lengthy zone of relatively constant temperature.

The spraying chamber 34 has an exit opening 42 and is provided with a drain outlet 44 in the bottom thereof, the latter being connected with a liquid supply tank 46 by a conduit 48. Mounted within the chamber 34 is a manifold ring 50 having a plurality of inwardly directed, high pressure nozzles 52 mounted thereon, the manifold ring 50 being connected to a conduit 54 to the outlet of a pressure pump 56, the inlet of which is connected with the supply tank 46.

The housing 30 can be oriented either vertically or horizontally, with suitable modifications, but it has been found that a horizontal orientation works well. Typically, the incineration chamber 32 can be about 16 feet in length, and the manifold ring 50 will carry about 40 nozzles directed to ensure that all portions of a seafood pot issuing from the incineration chamber 32 will be impacted by high pressure liquid, usually water. The seafood pots 2 are moved through the housing 30 and the chambers 32 and 34 by a conveyor 58, which can assume different forms. For example, a belt conveyor can be utilized, or an overhead traveling chain conveyor, from which the seafood pots 2 are suspended. The latter has been found to work well in actual use.

Figure 3:
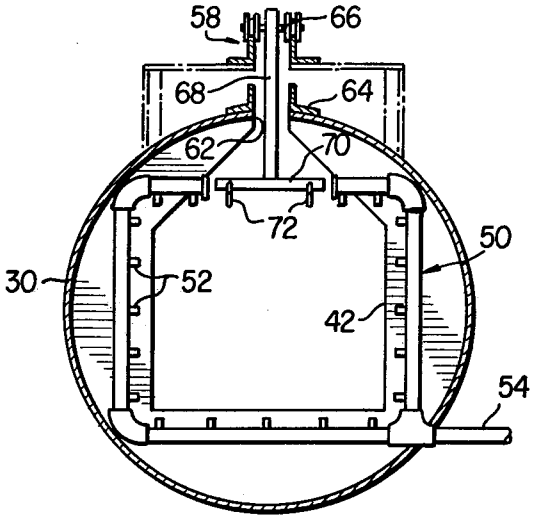
FIG. 3 is a cross-sectional view, taken generally along the line 3—3 of FIG. 1, showing the arrangement of the high pressure spray apparatus of the apparatus of FIG. 1.
Figure 2:
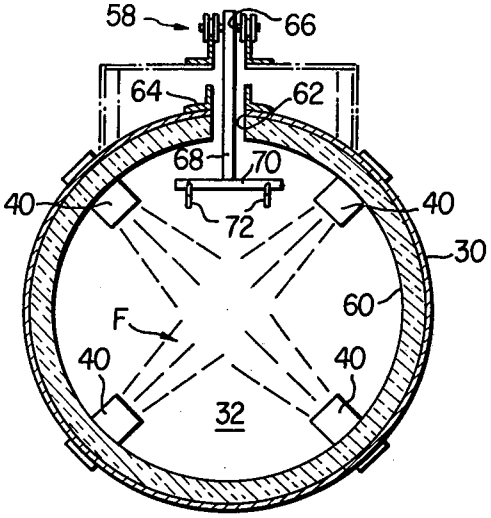
FIG. 2 is a cross-sectional view, taken generally along the line 2—2 of FIG. 1, showing the internal arrangement of the incinerator of FIG. 1.

Referring now to FIGS. 2 and 3, details of a typical horizontally-oriented incineration and spraying assembly constructed according to the invention are illustrated. In these FIGS., the housing 30 is an elongated, cylindrical vessel made of steel, with the interior of the incineration chamber 34 being lined with suitable insulation material 60 to hold heat generated by the four oil burners 40. The top of the horizontally disposed housing 30 has an elongated slot 62 running the length thereof, and longitudinally extending angle iron guides 64 are welded to the exterior, top surface of the housing 30 on both sides of the slot 62. A chain conveyor 66 is mounted above the slot 62 and extends the full length of the housing, and arms 68 depend therefrom that carry crossbars 70 on their lower ends. Hooks 72 are mounted on the crossbars 70, and seafood pots 2 are simply suspended from the hooks 72 of each crossbar for movement through the housing 30. By using a proper combination of heat generated by the oil burners 40 and conveyor speed, the dwell time of the seafood pots within the chamber 32 can be set for an optimum operational condition, described as that condition wherein all foreign matter is either burned, melted or loosened from the wire mesh netting and frame of the seafood pot, and no damage because of excessive heat is caused to the pot. The preferred fan-shaped flame patterns are indicated at F in FIG. 2.

In FIG. 3, the manifold ring 50 is shown to have a generally rectangular configuration, with a gap formed in the top of the ring to provide for passage of the conveyor arms 68. Obviously, other configurations and arrangements for the manifold ring and the high pressure nozzles are possible, toward the goal of obtaining maximum impact on the just incinerated seafood pot 2 by streams of high pressure liquid. Material removed from the seafood pot by the liquid spray, which will typically include residual burned material and pieces of mill scale and of marine life encrustations that have been loosened by the incineration step, will discharge with the spent liquid through the drain conduit 48. The system as shown in the drawings is intended to be closed cycle, and the supply tank 46 includes a settling portion wherein waste matter is allowed to settle from the spent liquid, and liquid cooling occurs. Obviously, other arrangements for supplying spray liquid to the system can also be designed and utilized.

Returning now to FIG. 1, after the seafood pots 2 emerge on the conveyor means 58 from the spraying chamber 34, they are ready for galvanizing and are moved progressively through a series of work stations to effect such galvanizing. The general steps for and technical aspects of galvanizing a steel object are known and, hence, will not be described in great detail herein. For example, U.S. Pat. No. 2,520,658 provides considerable generalized technical data on how galvanizing like that comtemplated in this invention is accomplished. The present invention, however, does include two important innovations in the method and apparatus for galvanizing, and such will be described hereafter.

After emerging from the exit opening 42, the just cleaned seafood pots 2 are first immersed in a caustic and soda bath 80 and removed therefrom, and are then passed through a rinse bath 82, a pickling solution bath 84, and a final rinse bath 86. They are then ready for the preflux bath 88.

Figure 4:
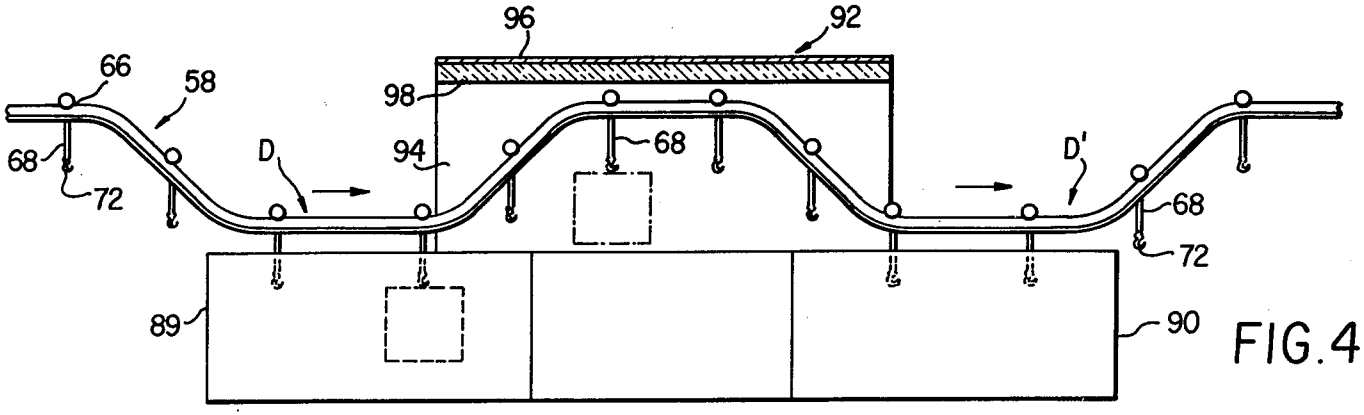
FIG. 4 is a longitudinal cross-sectional view, taken generally along the line 4—4 of FIG. 1, showing the relative arrangement of the preflux tank and the molten zinc kettle, the inverted drying chamber, and the conveyor for moving the seafood pots through the apparatus.

Referring now to FIGS. 1 and 4, the tank 89 containing the preflux bath 88 is aligned with, but spaced from the kettle 90 containing the molten zinc, both the preflux bath tank 89 and the kettle 90 being heated. It has been found that if the seafood pot 2 is immersed into the zinc kettle 90 before the preflux is sufficiently dry, spattering of the zinc and an uneven coating on the pot may result. Thus, it is preferable to effect drying of the preflux, and this is done in a unique manner in the invention, utilizing the heat emitting from the hot preflux bath and the molten zinc.

As shown in FIGS. 1 and 4, an inverted drying chamber 92 formed with side walls 94 and a top wall 96 is positioned so that the opposite end portions thereof overlap and rest on both the preflux bath tank 89 and the zinc kettle 90, so that it receives heat emitted therefrom. The inner surface of the chamber 92 is preferably lined with insulation 98 to hold heat therewithin. The supporting structure for the chain conveyor 66 follows the path as shown in FIG. 4, with a first dip D being formed therein to effect passage of the seafood pot through the preflux bath 88, and a second dip D′ being formed therein to pass the seafood pot through the zinc kettle 90; between the dips D and D′, the chain conveyor supporting structure runs in an elevated position through the drying chamber 92. The arrangement shown in FIG. 4 has been found to be most efficient in use, and drying is effected while at the same time fuel consumption is not increased.

It has been found that the molten zinc may not be evenly distributed over the wire mesh netting of a seafood pot 2, if the pot is simply hot dipped into the molten zinc kettle 90 are removed. It is important that the zinc coating be even, however, if good protection is to be afforded the seafood pot while such is in the water, and the formation of bare spots on the steel is to be avoided. In order to assure such even distribution, a vibrator device 100 (FIG. 1) is mounted adjacent the exit end of the molten zinc kettle 90, and such includes a vibrator arm 102 that projects over the kettle in a position to engage a seafood pot 2 as it is being elevated from the molten zinc by the conveyor system 58. Engagement of the vibrator arm 102 with the seafood pot 2 effects vibration thereof which, in turn, will cause the zinc to become evenly distributed in a very short time. The apparatus used to effect vibration of the seafood pot 2 as it emerges from the molten zinc kettle 90 can, of course, take different forms.

The inverted drying chamber arrangement and the concept of vibrating the emerging seafood pot are believed to be innovative in galvanizing generally, and certainly are innovative in producing a high quality galvanized seafood pot. The galvanizing process of the invention is thus improved over what has gone before and, more importantly, is the first capable of mass producing seafood pots of high quality.

Figure 6:
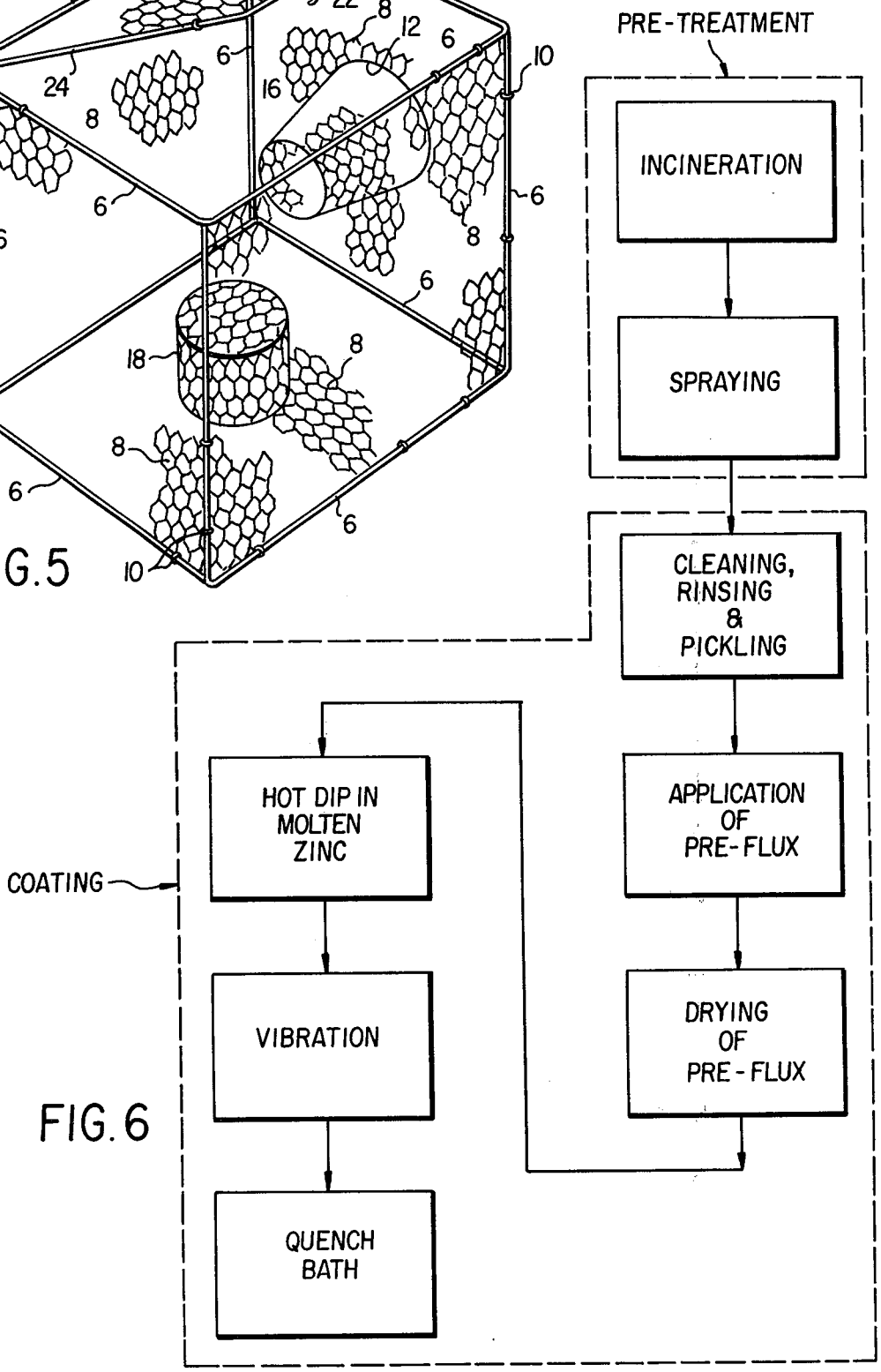
FIG. 6 is a diagrammatic representation of the present method for galvanizing seafood pots.

The galvanizing method of the present invention can be divided into a pretreatment portion and a coating portion, and the steps of both portions are illustrated in diagrammatic form in FIG. 6. The pretreatment portion of the method includes as a first step passing the wire mesh netting seafood pot 2 through an incinerator means to burn, melt and loosen foreign material adhering thereto and contained therewithin. The foreign material to be found on a seafood pot will typically include mill scale, tar and oil, rust, and spatterings of other materials. If the seafood pot has been in use in the water, as would be true for regalvanizing, then it will probably also have some galvanizing remaining on its surface, along with marine life encrustations, and will usually contain watergrown vegetation of various types. In the invention, any tar and remaining zinc or the like are melted in the incineration step, vegetable and similar matter are burned, and marine life encrustations are loosened by the heat, along with rust and the like.

In the second step of the pretreatment portion of the present method, the seafood pot is passed immediately from the incineration step through a spray of high pressure liquid, with the liquid playing on all surfaces of the pot. The liquid spray is effective to remove loosened material and to wash away any residual burned matter. Further, the quenching action of the liquid on the hot steel acts to anneal it and to preserve its desirable characteristics. The cleaned seafood pot is then ready to move on to the coating portion of the method.

In the coating portion of the present method, the cleaned seafood pot is successively immersed in and removed from cleaning, pickling and preflux solutions to prepare the wire mesh netting and the other component elements of the pot for the molten zinc. The technical details of this are known in the art and can be varied to obtain the best results.

After emerging from the preflux bath, the seafood pot is then passed through a heated chamber to effect drying of the preflux. Thereafter, it is passed through the molten zinc contained in the zinc kettle to effect coating thereof. In the next step of the method, the just-coated seafoot pot is vibrated as it is emerging from the zinc kettle to effect even distribution of the molten zinc thereover. Then, the coated seafood pot is passed through a quenching liquid bath 104, and the completed seafood pot is removed from the conveyor means 58. The completed pot can simply be stored on location, or it can be placed on a conveyor belt 106 driven by a motor 108 and moved to another location.

It is again emphasized that the incineration step is most effective to clean even a well-used and dirty seafood pot. The thermal shock effect provided with the present invention of the incineration step followed by the spraying step will remove even stubborn and large encrustations from the netting and the frame.

As was described above, the present invention makes possible a basic change in the manner in which the seafood industry now operates, a change that is of great benefit to fishermen and consumers alike. Obviously, modifications and variations of the invention are possible beyond those described herein.

What is claimed is:

1. In a method for galvanizing a wire mesh netting seafood pot, the preliminary steps before passing the seafood pot through a caustic cleaning solution and onward to other steps of the galvanizing process of:

passing said wire mesh netting seafood pot through incinerator means to burn, melt and loosen foreign material adhering thereto and contained therewithin, wherein within said incinerator means said seafood pot is passed through a plurality of flame jets arranged about the perimeter and directed toward the interior of said pot, whereby the flame jets play through the wire mesh netting of said pot and reach foreign material contained therewithin; and passing the seafood pot from the incinerator means through a high pressure liquid spray to remove residual burned matter and loosened foreign material therefrom.

2. In a method as recited in claim 1, wherein said seafood pot is continuously moved through said incinerator means and said high pressure liquid spray by conveyor means, whereby the dwell time of said seafood pot within said incinerator means is controlled to prevent melting of the wire mesh netting and other components of said pot.

3. In a method as recited in claim 1, wherein said seafood pot is continuously moved through said incinerator means and said high pressure liquid spray, whereby the dwell time of said seafood pot within said incinerator means is controlled to prevent melting of the wire mesh netting and other components of said pot.

4. The method for galvanizing a wire mesh netting seafood pot comprising the successive steps of:

passing said wire mesh netting seafood pot through incinerator means to burn, melt and loosen foreign material adhering thereto and contained therewithin, wherein within said incinerator means said seafood pot is passed through a plurality of flame jets arranged about the perimeter and directed toward the interior of said pot, whereby said flame jets play through the wire mesh netting of said pot and reach foreign material contained therewithin;

passing the seafood pot from the incinerator means through a high pressure liquid spray to remove residual burned matter and loosened foreign material therefrom;

successively immersing the seafood pot in and removing it from cleaning, pickling and preflux solutions to prepare the wire mesh netting and other component elements thereof to receive molten zinc; and immersing the seafood pot in and removing it from a kettle of molten zinc to place a zinc coating thereon.

5. The method as recited in claim 4, including the additional step before coating said seafood pot with zinc of:

passing the seafood pot through a heated chamber to effect drying of said preflux.

6. The method as recited in claim 4, including the additional step after coating said seafood pot with zinc of: immersing the zinc-coated seafood pot in and removing it from a quenching liquid.

7. The method as recited in claim 4, wherein said seafood pot is moved at a relatively constant rate of speed by conveyor means from said incinerator means through said kettle of molten zinc.

8. The method as recited in claim 4, including additionally the step of:

vibrating said seafood pot while it is being removed from the kettle of molten zinc to facilitate even distribution of the zinc coating on the wire mesh netting and other component elements thereof.

9. The method as recited in claim 4, wherein said seafood pot is continuously moved through said incinerator means and said high pressure liquid spray, whereby the dwell time of said seafood pot within said incinerator means is controlled to prevent melting of the wire mesh netting and other components of said pot.

* * * * *